US006948747B1

(12) United States Patent
Kaegi

(10) Patent No.: US 6,948,747 B1
(45) Date of Patent: Sep. 27, 2005

(54) SECURITY SEAL TO BE PULLED THROUGH

(75) Inventor: Dominik Kaegi, Arbon (CH)

(73) Assignee: Stoba AG, Horn (CH)

( * ) Notice: Subject to any disclaimer, the term of this patent is extended or adjusted under 35 U.S.C. 154(b) by 0 days.

(21) Appl. No.: 10/239,626

(22) PCT Filed: Mar. 23, 2000

(86) PCT No.: PCT/CH00/00168

§ 371 (c)(1),
(2), (4) Date: Feb. 5, 2003

(87) PCT Pub. No.: WO01/71699

PCT Pub. Date: Sep. 27, 2001

(51) Int. Cl.[7] ..... B65D 27/30
(52) U.S. Cl. ..... 292/319; 292/321; 292/323
(58) Field of Search ..... 292/307 R, 315, 292/317–323, 325, 327; 24/16 PB, 30.5 P, 24/17 AP, 17 A

(56) References Cited

U.S. PATENT DOCUMENTS

| | | | | |
|---|---|---|---|---|
| 601,770 | A * | 4/1898 | Dockstader | 292/327 |
| 712,250 | A * | 10/1902 | Brooks | 292/318 |
| 1,188,886 | A * | 6/1916 | Booth | 292/327 |
| 2,840,409 | A * | 6/1958 | Ashworth | 292/317 |
| 3,597,803 | A | 8/1971 | Van Neil | |
| 4,240,183 | A * | 12/1980 | Sumimoto et al. | 24/16 PB |
| 5,031,943 | A * | 7/1991 | Scott et al. | 292/307 R |
| 5,907,891 | A | 6/1999 | Meyer | |
| 6,009,997 | A * | 1/2000 | Deschenes et al. | 206/346 |
| 6,511,108 | B1 * | 1/2003 | Roessner et al. | 292/320 |
| 6,612,139 | B1 * | 9/2003 | Costa | 70/57.1 |

FOREIGN PATENT DOCUMENTS

| | | |
|---|---|---|
| EP | 0 676 736 | 10/1995 |
| FR | 1 288 128 | 8/1962 |
| WO | WO95/27968 | 10/1995 |

* cited by examiner

*Primary Examiner*—Gary Estremsky
(74) *Attorney, Agent, or Firm*—Flynn, Thiel, Boutell & Tanis, P.C.

(57) ABSTRACT

A pull-through security includes a base body and a tongue that protrudes therefrom and can be inserted through a pull-through opening that is arranged in a housing component connected to the base body. A restraint inset is arranged in the housing component. The tongue is provided with toes which protrude towards the outside in a rectangular-shaped manner when seen in the cross section. The toes engage with hooks in a toothed manner, whereby the hooks are arranged in the restraint inset. The housing component is provided with an outlet. The cross section of the outlet matches the cross section of the tongue having the toes. The form practically prevents the hooks from being manipulated by simple, flat tools. Influence or manipulation of the toothing between the toes and the hooks can practically be excluded.

16 Claims, 4 Drawing Sheets

SECURITY SEAL TO BE PULLED THROUGH

FIELD OF THE INVENTION

The present invention relates to a pull-through security seal.

BACKGROUND OF THE INVENTION

Pull-through security seals in which a band or strip having locking means is pushed through a receiving opening arranged at one end of the band or strip, and is prevented from being pulled out by means of restraining means mounted in the receiving opening, are known, for example, from WO 95/27968. This reference shows among others a seal which has a flat base body with a push-through opening directed perpendicularly with respect to the surface. A looping member in the form of a flat tongue or flange is constructed directly on the base body leading away perpendicularly with respect to the push-through direction. The end of this tongue can now be guided in one direction into the push-through opening and can be pushed therethrough. A loop is formed thereby, the size of which, namely its diameter, can be influenced by the extent of the length of the tongue pushed therethrough. This loop becomes smaller with an increasing length of the tongue pushed therethrough. Since the restraining means in the push-through opening prevent a pulling back of the tongue, the loop can be opened only by breaking or tearing of the tongue.

Furthermore, pull-through security seals are also known in which the tongue is formed out of one side with an essentially circular cross section, which seals have at regular intervals ball-shaped or conically-shaped nubs which can engage resilient restraining means arranged in the push-through opening of the seal. With this it is possible to achieve a reliable locking of the tongue in one direction, and the loop can be reduced, particularly tightened, corresponding with the distances between the nubs at discrete distances corresponding with the needs.

The problem of such security seals lies in preventing a manipulation of the locking function, namely in preventing a not noticeable manipulation of the lock of closed seals to effect an opening and a subsequently closing from occurring.

Thus common security seals with flat tongues have the disadvantage that with thin small plates, after locking of the seal from the push-in side, the restraining means can be blocked. Thus it becomes possible to pull the tongues without noticeable damage out of the push-through opening and to thus open the loop. The seal can subsequently, as intended, be locked and a manipulation cannot be noticed.

The same problem occurs also in the case of pull-through seals, the tongues of which have a circular cross section and have tooth elements also having a circular cross section. In addition, such seals have the problem that with simple means, as, for example, a thin-walled sleeve in the correct dimensions, which sleeve can be manufactured with very simple means, it is possible to block, particularly to render functionless, the locking mechanism from the outlet side of the push-through opening. Thus it is possible to pull the tongue also, as already described above, again out of the push-through opening, and to open the loop, and to lock same thereafter again without such action being noticed.

The mentioned tools for both known types of seals can, due to their simple geometric design, be manufactured with simple means without great expense.

The purpose of the present invention was now to find a pull-through security seal of the mentioned type which has a high manipulation safety during locking.

SUMMARY OF THE INVENTION

The tongue of the pull-through security seal of the invention does not have a geometrically simple cross section, but a cross-sectional shape having edges. Thus a high manipulation safety is achieved. This shape makes the manufacture of a suitably designed and effective manipulation tool very difficult and it is made practically impossible without special machine tools, great expense and advanced technical knowledge.

The inventive design nevertheless is able, as by comparison to the circular cross section of the tongues of common pull-through seals, to absorb large pull forces through the multiple tooth systems.

In order to simplify the threading of the tongue into the pull-through opening of the base body, guiding elements are preferably arranged in the area of the tip of the tongue in front of the tooth-like toe, which guiding elements guide the tongue.

The number of the toes, which are arranged circularly in cross section, can basically be variably chosen depending on the area of use and size of the seals, particularly the dimension of the tongue. It has been found that on the one hand the symmetric arrangement of four toes in a cross shape has proven to be successful both in manufacture and also in operation.

The preferred shape of the toes in the shape of rectangular triangles with flattened tip can, of course, also be adapted to the restraining means and can be suitably modified.

In order for the pull-through seal to be able to be also again removed in a simple manner without the aid of tools after use, it is preferably provided that the tongue is guided from the front laterally along one edge of the base body of the seal and is connected to the base body by webs. These webs serve as a rated break point and thus enable a simple tearing open of the locked seal.

The end of the tongue, which end is on the side of the base body, is preferably not guided all the way to the rear end of the base body but ends at a flange constructed at this point on the base body. Thus it is possible to manufacture the seals, which usually are made of a plastic, simply via injection tools in large amounts as piece goods, whereby the seals connect advantageously only through webs which are connected only directly to the base body, particularly the flange. These webs are now also designed as rated break points so that the individual seals can be easily separated from the piece goods. These connecting webs are dimensioned in such a manner that they have a lower tearing force, particularly breaking force, than the rated break points between the tongue and the base body. It is prevented in this manner that during separating of the seals one seal is erroneously destroyed by tearing off the tongue.

The outlet of the housing compartment housing the restraining means is designed corresponding with the cross section of the tongue in such a manner that at this point no common, simply designed tube-shaped manipulation means can be introduced in order to prevent the engagement between the tongue, particularly the toes and the restraining means.

The inlet has guiding ribs which are designed also preferably corresponding with the cross-sectional shape of the tongue, and which are arranged parallel with respect to the pull-through direction inside of the housing compartment, preferably in front of the restraining means themselves.

BRIEF DESCRIPTION OF THE DRAWINGS

Exemplary embodiments of the present invention will be discussed hereinafter in greater detail in connection with the drawings, in which.

DETAILED DESCRIPTION

Figure 1:
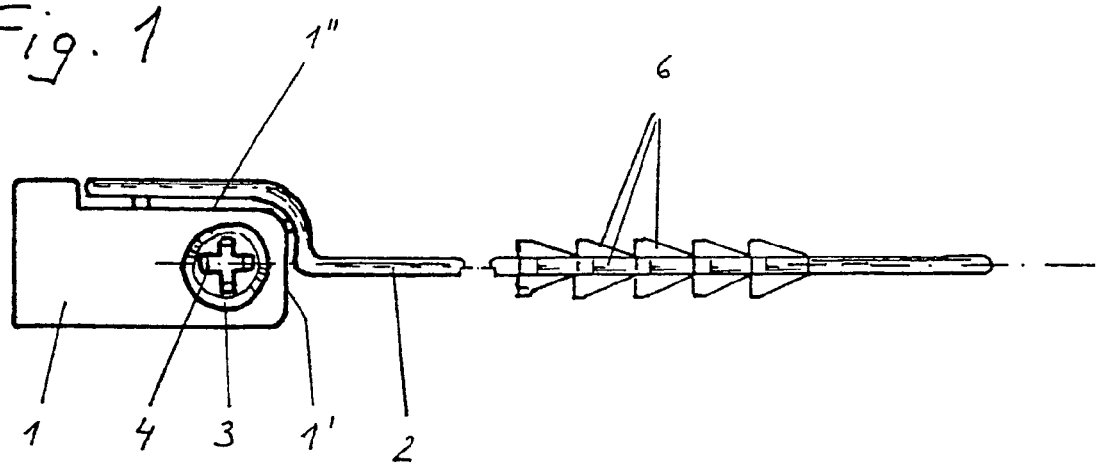
FIG. 1 is a top view of a pull-through security seal of the invention.

FIG. 1 illustrates a schematic top view of a pull-through security seal designed according to the invention with a flat, essentially rectangular base body 1 and a tongue 2 protruding therefrom. A cone-shaped housing component is constructed on the base body 1, inside of which housing component are arranged the restraining means 4.

Figure 2:
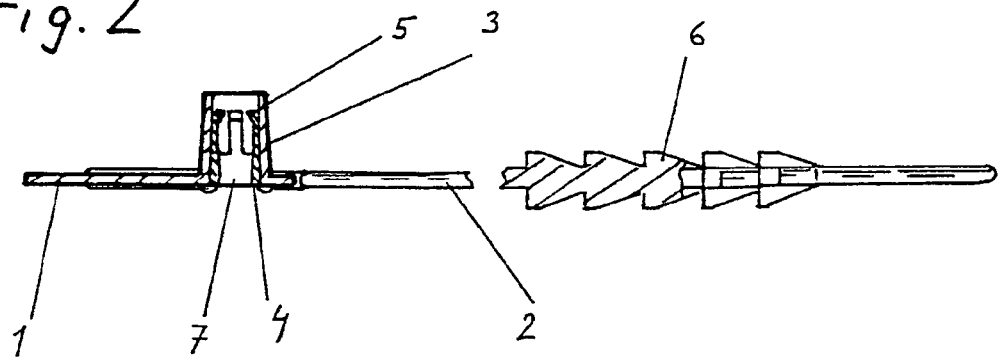
FIG. 2 is a schematic longitudinal cross-sectional view of the pull-through security seal of FIG. 1.

These restraining means are designed in a common conventional manner with radially extending resilient hooks 5, which engage the tooth-like designed toes 6 of the tongue when same is introduced through the pull-through opening 7 of the housing component 3. This can be seen in the schematic illustration of the longitudinal cross section of this seal in FIG. 2.

The restraining means 4 are, for example, fixedly and non-releasably connected to the base body 1 through welding.

The tongue has, for example, a circular base cross section and has toes 6, which are arranged successively on one or, if necessary, several sections along its longitudinal axis. These toes 6 are preferably designed as triangles with flat side portions 6' and flattened tip, which triangles protrude radially outwardly from the tongue body.

Figure 3:
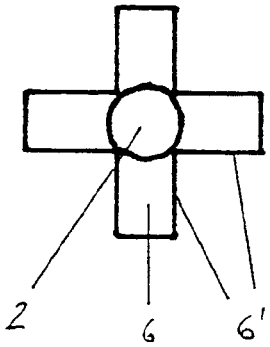
FIG. 3 is a front view of an inventively designed tongue each having four toes.

FIG. 3 illustrates in the front view a preferred cross-sectional shape of the tongue 2 with four rows of toes 6. The toes 6 have thereby essentially a rectangular cross section, namely, the side portions 6' are designed extending flat along the longitudinal axis of the tongue 2. The toes 6 are designed cross-shaped in cross section and each are preferably arranged directly following one another on the tongue 2.

Figure 4:
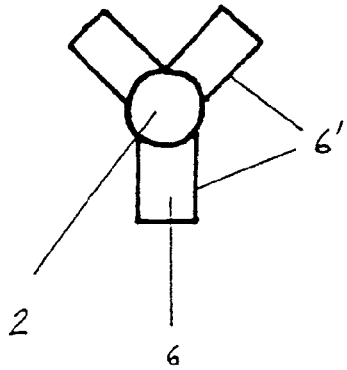
FIG. 4 is a front view of an alternative design of the tongue of the invention each having three tooth-shaped toes.

FIG. 4 illustrates a further, alternative cross-sectional shape of an inventive tongue 2, where the rows of toes 6 are triangularly arranged in cross section. This arrangement can be designed either symmetrically with respective equal angled intervals from one another, or as illustrated in FIG. 4 irregularly.

A manipulation tool would now have to be manufactured as an extremely thin-walled sleeve with the corresponding cross section in order to be able to influence, if necessary, the restraining means 4 to the respective hooks 5. This can be very easily accomplished in common pull-through seals having a completely symmetrical, circular cross section or simple, flat cross sections, whereas the illustrated cross-sectional shapes can only be manufactured, if at all, with a very great complexity, thus substantially avoiding the danger of manipulation.

Figure 5:
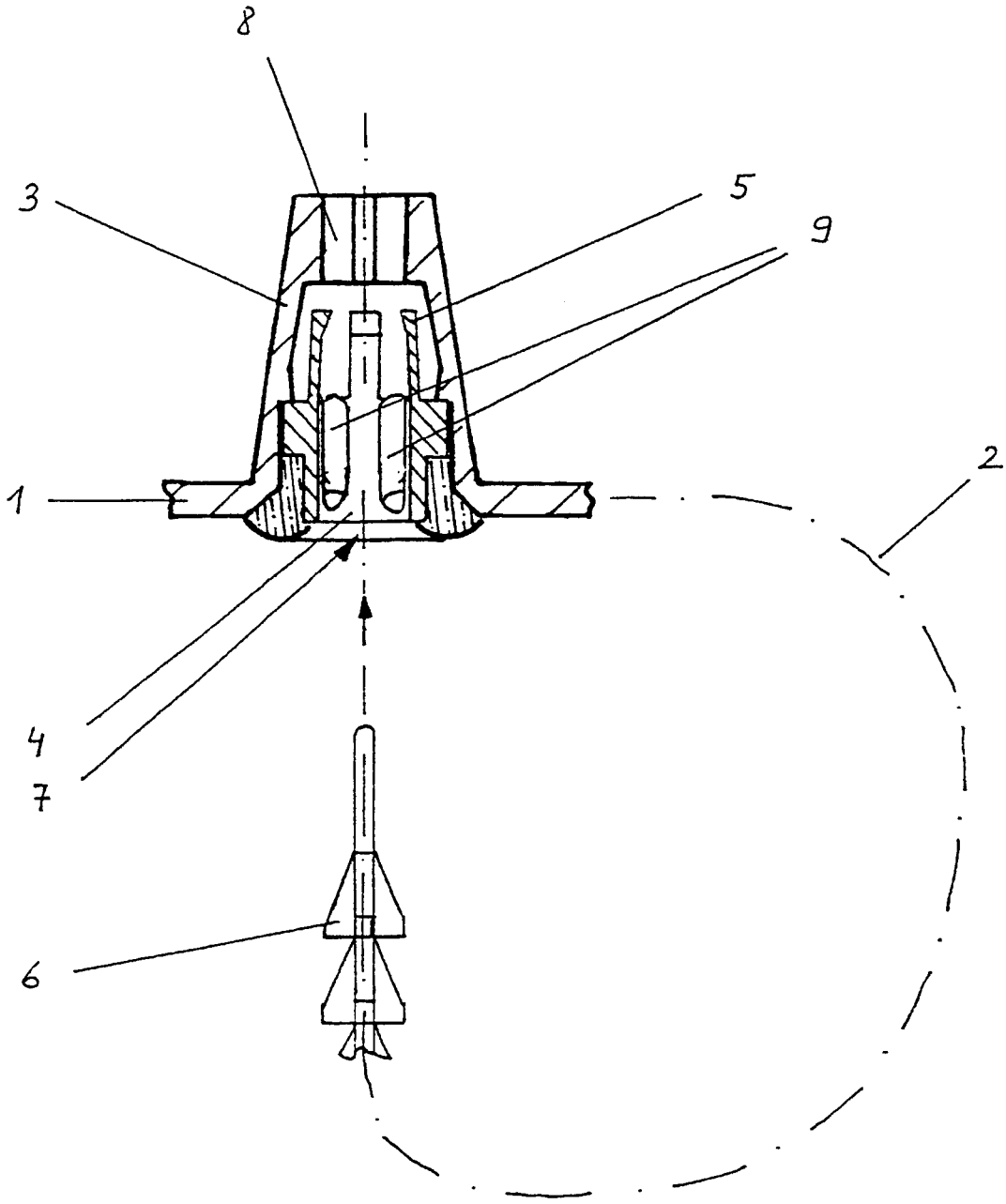
FIG. 5 is a schematic longitudinal cross-sectional view of the restraining means arranged in the base body.

FIG. 5 illustrates schematically the longitudinal cross section of the housing component 3 of the base body 1 with inserted and welded restraining means 4. The radially resilient arranged hooks 5 are expanded upon introduction of the tongue 2 into the pull-through opening 7 in direction of the arrow by the inclined extending edges of the toes 6, and engage against the rear edges of the toes when the tongue is pulled back, which rear edges extend perpendicularly with respect to the pull-through direction. The actually known restraining construction effectively prevents the tongue 2 from being pulled out of the housing component 3 of the base body 1 opposite to the pull-through direction. The outlet 8 of the housing component 3 has now advantageously also a cross-sectional shape corresponding with the tongue 2, as this is illustrated in FIGS. 3 and 4. This practically completely prevents a manipulation attempt from the outlet opening 8 with only simple tools.

Guiding ribs 9 are constructed in the area of the pull-through opening 7, which are arranged preferably parallel to the pull-through direction inside of the restraining means 4. These guiding ribs 9 result again in an open cross section corresponding approximately with the cross-sectional shape of the tongue 2, and rotate in particular the tongue 2 into the correspondingly correct opposition so that the toes 6 each come into central contact with the corresponding hooks 5, and thus permit a reliable engagement of the tongue 2 with the base body 1.

Figure 6:
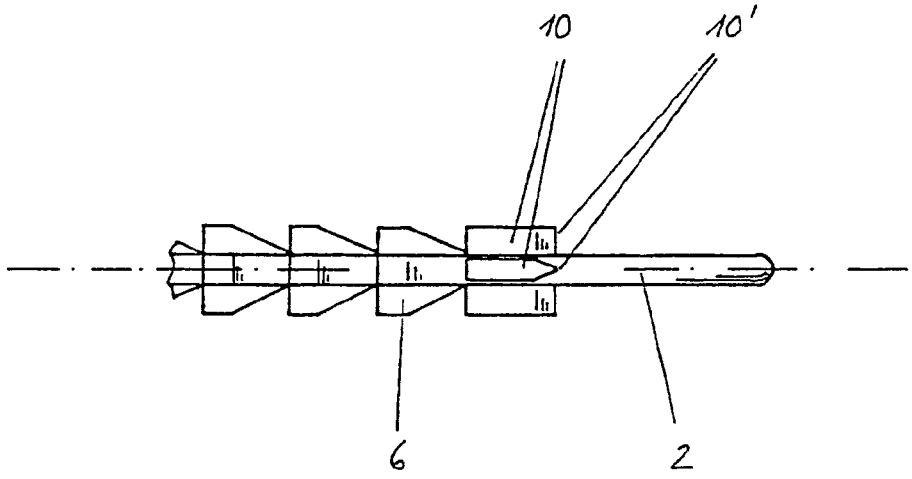
FIG. 6 is a schematic view of a tip of a tongue with additional guiding elements.

In order to further simplify the guiding in of the tongue 2, guiding elements 10 are advantageously constructed directly in front of the front-most toe 6 preferably in the area of the tip of the tongue, as this is illustrated in FIG. 6. These guiding elements 10 have, for example, an essentially rectangular base shape with a wedge-shaped, straight front edge 10'. The cross section of these guiding elements 10 corresponds advantageously with the cross section of the corresponding toes 6, and the guiding elements 10 are arranged in alignment with the respective rows of toes on the tongue 2.

Figure 7:
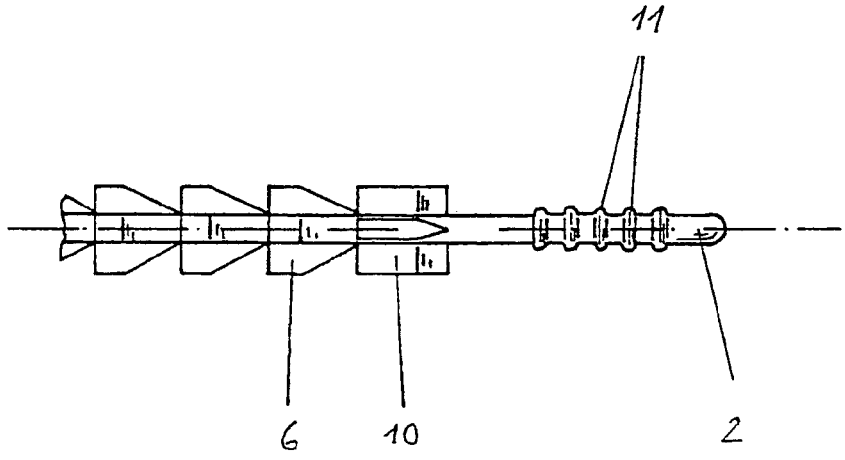
FIG. 7 is a schematic view of a further tip of a tongue having annular beads.

The tip of the tongue in front of the respective rows of toes, respectively the guiding elements 10, can furthermore have a number of circularly shaped beads 11. These beads 11 have a diameter, which is less in comparison to the diameter of the toes 6, as this can be seen in FIG. 7.

Figure 8:
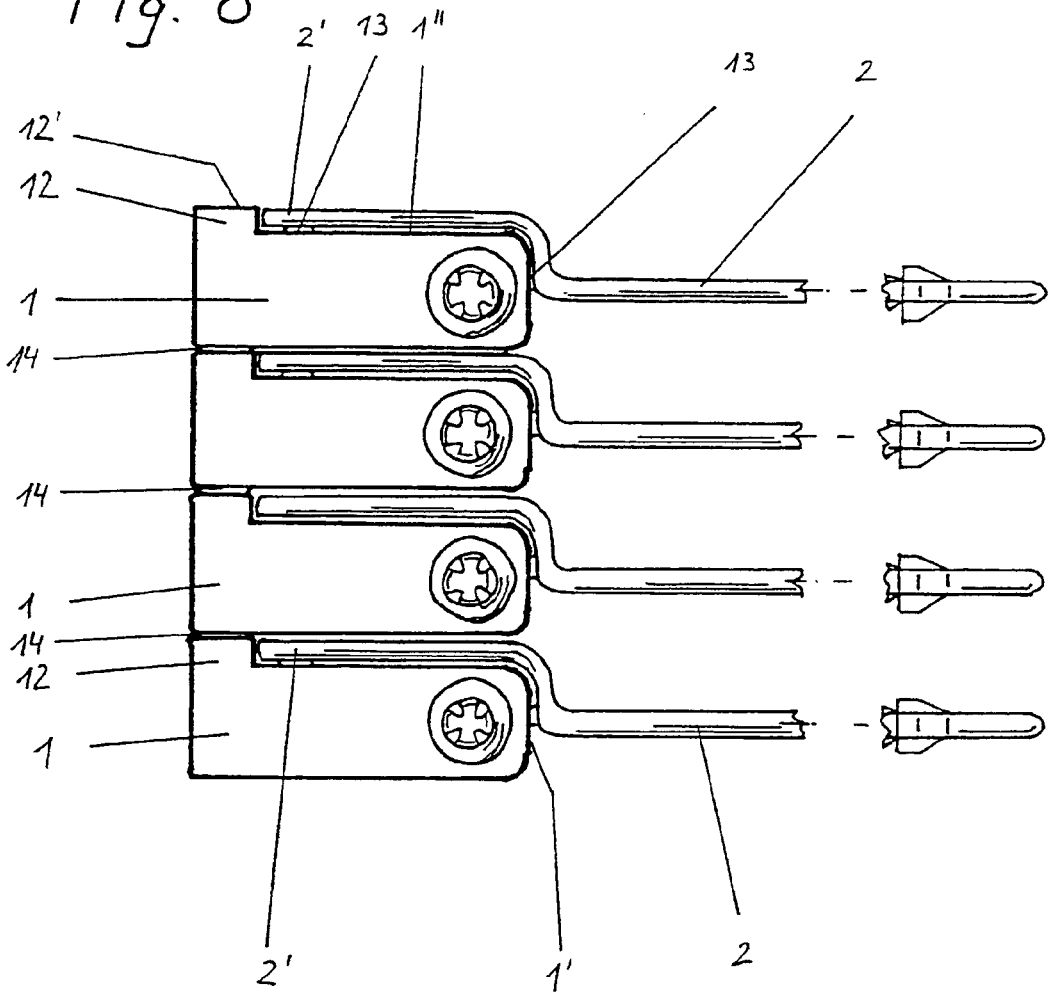
FIG. 8 is a view of an inventive set of pull-through security seals.

FIG. 8 schematically illustrates in addition a set of pull-through seals, as same is usually produced as piece goods. The tongue 2 is designed, as already shown in FIG. 1, preferably protruding from the center of the front edge 1' of the base body 1, and the rear end 2' extends along the front edge 1' and rearwardly along the side edge 1". A flange 12 is constructed in the base body 1 directly behind the end 2' of the tongue 2, the side edge 12' of which flange 12 is constructed at a distance at least at the level of the extended outer edge of the end 2' of the tongue.

The tongue 2 particularly the end 2' of the tongue, is preferably connected to the base body 1 through the two webs 13. These webs 13 serve advantageously as rated break points, through which the tongue 2 after use can be simply torn off from the base body 1 without that special tools or cutting devices would be needed to accomplish this task.

The individual pull-through seals themselves are now preferably each connected with one another also through webs 14 as piece goods, whereby these webs are constructed each oriented directly between the side edges and flanges 12 of adjacent pull-through seals during the injection process. These webs 14 are now advantageously dimensioned in such a manner that they serve as rated break points during separation of the pull-through seals. The thickness of these webs 14 is at the same time dimensioned in such a manner that the tearing force, particularly the breaking load thereof, is less than is the tearing force for the webs 13 oriented between the base body 1 and the tongue 2. Thus, it can be advantageously prevented that, instead of the separation of the individual pull-through seals from the piece goods, the tongues 2 are unintentionally torn off from the base body 1, and thus the seals are destroyed prior to use.

What is claimed is:

1. A pull-through security seal comprising a base body and a flexible tongue protruding therefrom, the tongue having a longitudinal axis along a length thereof, and a housing compartment having a restraining apparatus comprising resilient members for the tongue, said housing compartment being arranged directly on the base body and having a pull-through continuous opening, wherein the tongue includes radially outwardly protruding rigid tooth-shaped toes secured at least along one section along the length of the tongue, wherein at least three of said toes are arranged at the same position along the length of said tongue and form plural edges in cross section.

2. The pull-through security seal according to claim 1, wherein the tongue has a circular base cross section.

3. The pull-through security seal according to claim 1, wherein four of the toes are arranged symmetrically with respect to the longitudinal axis of the tongue at the same position, and wherein ones of the toes, which lie one behind the other, are arranged along the longitudinal axis of the tongue in one straight row.

4. The security seal according to claim 3, wherein the toes each comprise a slender, rectangular triangle with a flattened tip, and have flat side portions secured along the length of the tongue and a uniform wall thickness.

5. The pull-through security seal according to claim 1, wherein in front of the one section with the toes, there are constructed wedge-shaped guiding elements having the same thickness and height as the toes and arranged aligned each in a same row parallel to a longitudinal axis of the tongue, the guide elements having a wedge-shaped face oriented toward the end of the tongue.

6. The pull-through security seal of claim 1, wherein the rigid toes each have a continuous width defined along the longitudinal axis of the tongue and the toes each have a flat outer radial surface increasing radially outwardly along a longitudinal length beginning at an end of the respective toe oriented toward an inserting end of said tongue that is insertable in the continuous opening.

7. A pull-through security seal comprising a base body and a tongue protruding therefrom, the tongue having a longitudinal axis along a length thereof, and a housing compartment having restraining apparatus for the tongue, said housing compartment being arranged directly on the base body and having a pull-through continuous opening, wherein the tongue includes radially outwardly protruding tooth-shaped toes secured at least along one section along the length of the tongue, wherein at least three of said toes are arranged at the same position along the length of said tongue and form plural edges in cross section, wherein a tip of the tongue has several beads spaced from one another at regular intervals, and an outside diameter of the beads is less than an outside diameter of the sections of the tongue provided with the toes so that the beads pass through the continuous opening.

8. A pull-through security seal comprising a base body and a tongue protruding therefrom, the tongue having a longitudinal axis along a length thereof, and a housing compartment having restraining apparatus for the tongue, said housing compartment being arranged directly on the base body and having a pull-through continuous opening, wherein the tongue includes radially outwardly protruding tooth-shaped toes secured at least along one section along the length of the tongue, wherein at least three of said toes are arranged at the same position along the length of said tongue and form plural edges in cross section, wherein in an area of the pull-through opening within the housing compartment there are constructed radially inwardly oriented guiding ribs angled to channel the tongue toward the center of the opening.

9. The pull-through security seal according to claim 8, wherein the guiding ribs are constructed rounded on their side in an area facing an entrance of the continuous opening.

10. A pull-through security seal comprising a base body and a tongue protruding therefrom and arranged around a front of the base body along a corresponding side edge lying in a plane of the base body, said tongue connected to said base body through at least two tongue connecting webs, each said connecting web separately joining the base body and the tongue, and a housing compartment arranged on the base body having a restraining apparatus for the tongue, the tongue having radially outwardly protruding tooth-shaped toes at least along a first section of said tongue, whereby at least three of said toes are arranged at the same position along the tongue and form plural edges in cross section, whereby the ends second section of the tongue is guided not quite to a rear edge of the base body, and that following thereafter on the base body there is constructed a laterally protruding flange lying in the base-body plane, a side edge of said flange extending at least to a continued outer contour of a third end section of the tongue, said third end section of said tongue being connected to the base body by one of said tongue connecting webs.

11. A set of pull-through security seals according to claim 10, wherein the base body comprises one of a plurality of base bodies connected with adjacent ones of said base bodies through at least one base body web which extends from the side edge of the flange of a respective said base body to the side edge of the adjacent base body, whereby strength of the base body web is measured to serve as a rated break point having a lesser tearing resistance than the tongue connecting webs of the individual pull-through security seals.

12. A pull-through security seal comprising:

a base body;

a tongue secured to the base body and protruding therefrom, said tongue including radially outwardly protruding rigid toes secured at least along one section along a length of the tongue, said toes comprising at least three said toes arranged at the same position along the tongue and projecting radially outwardly in different directions to form plural edges in cross section along the length thereof;

a housing compartment disposed with the base body;

a pull-through opening having an inlet on one side of the housing compartment and an outlet on another side of the housing compartment, the opening comprising a continuous open hole extending through the entire housing compartment; and a restraining mechanism disposed in the housing compartment comprising resilient members for receiving the rigid toes of the tongue, wherein said tongue is capable of being pulled through and beyond the entire length of the pull-through opening to enable said restraining mechanism to lock said rigid toes of said tongue.

13. The pull-through security seal according to claim 12, wherein the pull-through opening defines a straight bore hole extending through the housing compartment and having a longitudinal axis, and wherein said toes each comprise a triangular fin shaped member secured along the length of the tongue and oriented along the longitudinal axis.

14. The pull-through security seal according to claim 12, wherein said rigid toes comprise tooth-shaped toes, whereby said front angled ends of said tooth-shaped toes are capable of being forced through the pull-through opening and through said restraining mechanism and said flat rear ends of said toes, defining a face transverse to the longitudinal axis, are capable of contacting said restraining mechanism to prevent release of said tongue from said restraining mechanism.

15. The pull-through security seal according to claim 14, wherein said restraining mechanism comprises resilient hooks oriented to enable said tooth-shaped toes of said tongue to pass through said opening and prevent return of said tooth-shaped toes.

16. The pull-through security seal according to claim 12, wherein said toes are oriented symmetrically in a plane transverse to the longitudinal axis of said tongue.

* * * * *